US005378164A

United States Patent [19]

Vidacovich et al.

[11] Patent Number: 5,378,164

[45] Date of Patent: Jan. 3, 1995

[54] TIP FOR FORCING CONTACTS TO WIPE AGAINST EACH OTHER

[75] Inventors: Kenneth J. Vidacovich; Philip M. Smith; Richard J. Scherer; William D. McKittrick, all of Austin, Tex.

[73] Assignee: Minnesota Mining and Manufacturing Company, St. Paul, Minn.

[21] Appl. No.: 110,314

[22] Filed: Aug. 23, 1993

[51] Int. Cl.[6] ..... H01R 13/703

[52] U.S. Cl. ..... 439/188; 200/51.1

[58] Field of Search ..... 439/188, 482; 200/51.1

[56] References Cited

U.S. PATENT DOCUMENTS 4,106,841 8/1978 Vladic ..... 439/188
4,283,103 8/1981 Forberg et al. ..... 439/188
4,682,838 7/1987 Achtnig et al. ..... 439/598
4,741,711 5/1988 Singer, jr. ..... 439/620
4,789,354 12/1988 Smith et al. ..... 439/395
4,975,076 12/1990 Mosquera ..... 439/387
5,152,695 10/1992 Grabbe et al. ..... 439/71
5,277,607 1/1994 Thumma et al. ..... 439/188

*Primary Examiner*—Neil Abrams
*Attorney, Agent, or Firm*—Gary L. Griswold; Walter N. Kirn; John C. Barnes

[57] ABSTRACT

The contacts of an electrical connector are joined by the biasing force of the contact elements and in practice are separated by a probe to interconnect therebetween an additional circuit member. A probe which has a terminal end with an oblique surface to cause the wiping of the contact elements against each other at the interface during insertion or removal will improve contact and extend the life of the contact elements.

12 Claims, 4 Drawing Sheets

TIP FOR FORCING CONTACTS TO WIPE AGAINST EACH OTHER

BACKGROUND OF THE INVENTION

1. Field of the Invention

Present invention relates to a terminal end for a probe used to interrupt a circuit, introduce a parallel or series circuit; as used on an overload protector, a test access device, a patch cord or other electronic device; between pairs of contact elements, particularly in a telecommunication cross connect block and in one aspect to a terminal end affording the separation and remating of spring biased contact elements to cause the same to wipe against each other upon insertion and removal of the probe.

2. Description of the Prior Art

Termination and distribution connectors have been in use in the communications industry for a long time to afford rapid connection of distribution wires to a pair of wires of an incoming or outgoing cable. The systems are built for use with pairs of wires. Wire pairs are joined to at least one other pair to perfect the transmission. Also, it is very necessary that the splice between one pair and the other pair be readily accessible to disconnect, change or rearrange the connections and also to make series connections to the wire pairs for purposes of testing, protecting or otherwise monitoring each pair of lines. Therefore, the connections between the pairs of wires utilize contact members making electrical contact with each wire and then with themselves such that a pair of contacts join each pair of wires.

The support for the contacts afford the suitable support for incoming wires and the ready connection of outgoing or cross connect wires as illustrated in U.S. Pat. No. 4,789,354, assigned to the assignee of this invention. This patent illustrates contacts having a first leg formed with a U-shaped contact element to make an insulation displacing electrical connection to a conductor of a wire and a resilient spring contact. One form of the mating contact elements, formed of appropriate conductive resilient spring-type material, provides a current path that can be broken by the separation of the two spring contact elements which are normally in contact between the pairs of U-slot spring reserve insulation displacing contacts. A second form maintains a current path between the U-slot spring reserve contacts but allows a probe to be inserted between a pair of spring contacts. Contacts which perform the same function, i.e., parallel or series contact with a probe, are also illustrated in U.S. Letters Pat. No. 4,283,103. The differences are not in functions but in the construction of the contact elements and their relationship to the connector support structure.

It is the object of the present invention to provide such probe devices with terminal ends according to this invention which have the feature of causing a wiping action between the spring contacts when the probe is inserted between, or removed from between the pairs of spring contacts and one which will permit the probe to be inserted into the line without interruption of the normal splice between the contacts between the conductors until a second connection has been made.

The probe may have a circuit on the body, or the body may have the form of a printed circuit board such that the ultimate connection between the contacts and the body of the probe may be adapted to connect to the connected wire pairs in either parallel or series arrangement, but every connection or disconnection will result in the wiping of the opposed spring contact elements at the contact surface therebetween.

The construction and features of the present invention will be further described herein.

SUMMARY OF THE INVENTION

The present invention relates to a probe affording the breaking and making of an electrical connection between spring contacts of an electrical circuit and comprises a body having one terminal end adapted to engage a pair of resiliently mated electrical contacts of conductive material which are spring loaded normally into electrical contact. The terminal end has a free end and means defining an oblique surface extending at an angle to the terminal end and adapted for engagement with one edge of one of said contact elements for forcing it laterally of the other contact element. The probe has a third surface positioned between the oblique surface and the body for maintaining a contact element disposed at an angle to the other contact element after separation. The terminal end can have a pair of oblique surfaces for engaging separate contact elements on two adjacent sets of electrical contact elements, and have the oblique surfaces disposed diagonally with respect to said terminal end and said body whereby the oblique surfaces contact alternate contacts of two sets of adjacent contact elements.

In one embodiment, the terminal end has a first portion with opposite parallel surfaces terminating at a free end, and a second portion having a surface diverging from the free end, or oblique to the surfaces of the first portion, to engage a contact element and cause the transverse displacement thereof in relationship to the other contact element resulting in a wiping of the contact interface of the mating contact elements.

A probe according to the present invention may have a space separating the opposite surfaces of the first portion to afford registration of the terminal end in relationship to a pair of contacts, and the second portion comprises a pair of diverging surfaces and a similar space separating two parallel surfaces for engagement with the other contact elements of a pair of contacts to urge the same in opposite directions and out of the normal plane of contact.

The probe supporting the terminal end can have a circuit on the body, or the body may have the form of a printed circuit board such that the ultimate connection between the contacts and the body of the probe may be adapted to connect to the connected wire pairs in either parallel or series arrangement, but every connection or disconnection will result in the wiping of the spring contacts. Further, the body may support thin electrical circuit paths on at least one surface and adjacent to the terminal end for making electrical contact with said spring contacts upon insertion of the probe and separation of the contacts by said first and second portions of said terminal end.

DESCRIPTION OF THE DRAWING

The present invention will be explained in greater detail with reference to the accompanying drawing wherein.

DETAILED DESCRIPTION OF THE PRESENTLY PREFERRED EMBODIMENT

Figure 1:
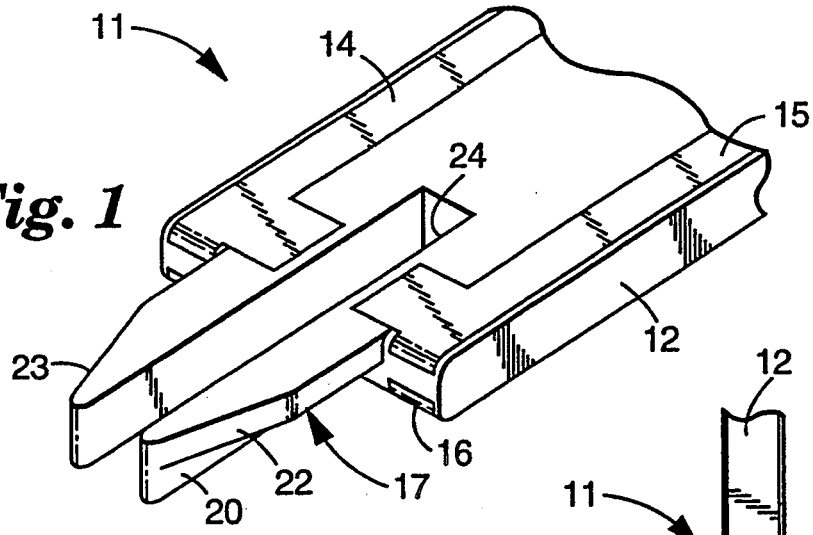
FIG. 1 is a perspective view of a probe having a terminal end according to the present invention.

The present invention will be described with reference to the accompanying drawing wherein like reference numerals refer to like parts throughout the several views.

Probes, which is used herein to describe protective devices, test devices, maintenance devices or patch cords for the telecommunications industry, have terminal ends for insertion into the distribution frames or cross connect frames as described in U.S. Pat. No. 4,789,354, incorporated herein by reference for the purpose of illustrating the type of frame which supports pairs of contacts with walls insulatively separating the pairs of contacts for the wire pair as referred to herein.

A probe 11, illustrated herein as fragmentary, has a body 12 which may support an electrical circuit device such as the protection module of U.S. Pat. No. 4,741,711 or the multipolar switch of U.S. Pat. No. 4,682,838, or even an end of a patch cord as is well known in the art. The body is provided with at least a pair of circuit traces 14, 15, as shown in FIG. 1, with similar traces 16 on the opposite face, which traces terminate at one end in pads to afford connection to the spring contacts of a cross connect frame. The body 12 of the probe 11 has a terminal end, generally designated 17, and hereinafter referred to as the tip, formed for inserting between two pairs of contacts to make contact between the contacts and the circuit traces 14, 15 and then separate the contacts or break the electrical connection therebetween. The body of the probe is wider than the tip for engaging the free ends of the spring contacts to make a connection separate from the normal connection interface, wherein the tip is, at its widest area, only slightly wider than the spacing between adjacent contacts of a pair of contacts 25 and 26. The contact elements of each contact are normally spring biased into connection and when breaking the connection it is highly desirable that a separate connection occurs in a location different than the normal electrical connection area. This is important because electrical arcing damages the two contact surfaces during connection or disconnection. When a device is removed from between the spring contacts the contacts are biased toward each other and will remake the connection. During the reconnection, it is beneficial if the two elements slide against each other to "wipe" across the electrical interface. This wiping action removes debris and thus cleans the contact faces at the interface. It is also beneficial to have the probe make electrical connection of the contact elements at a different point prior to disconnection at the normal interface to avoid arcing at the interface.

The probe 11 is generally injection molded and the tip 17 is formed integrally. The tip comprises a first separation portion with opposite parallel surfaces 20 and 21 terminating at the free end, and a second separation portion, disposed laterally of the first portion, having a surface 22, 23 diverging from the free end of the tip, or oblique to the surfaces 20, 21 of the first portion, to engage a contact element and cause the transverse displacement thereof resulting in a wiping of the contact elements at the interface of the mating elements. The oblique surface continues at an angle to the direction of insertion of the probe, substantially equal to the width of the contact element engaged and then has a surface parallel to the direction of insertion, connecting the oblique surface to the body, for maintaining the contact elements in the laterally displaced relationship. Separation of the contact elements depend on the transverse width of the second portion.

A probe 11 according to the present invention has a recess 24 defining a space separating the surfaces 20, 21 and defining additional surfaces parallel to the surfaces forming the first portion and surfaces opposite the oblique surfaces of the second portions defining the tip 17. The recess 24 affords registration of the probe in relationship to pairs of contacts and/or a support surface to engage the insulative wall (not shown) of a support to allow the portions to cause the wiping of the contact elements of a pair of contacts 25 and 26 prior to separation and upon engagement. Each of the pair of contacts 25 and 26 comprise two mating spring contact elements 28, 29 and 30, 31 respectively. As illustrated schematically in FIG. 3, the spring contact elements 28, 29, 30, 31 are formed with converging portions extending from a base, terminating at a bow defining an interface where the elements are normally in engagement and then diverging upwardly and converging again, affording a second connection area for connection to a circuit path on the probe and diverging therefrom affording a throat or entry area for receipt of the adjacent end of the body of a probe, i.e. a test tool or protective device or the like, between the ends of the contacts which affords separation at the normal electrical interface.

Figure 2:
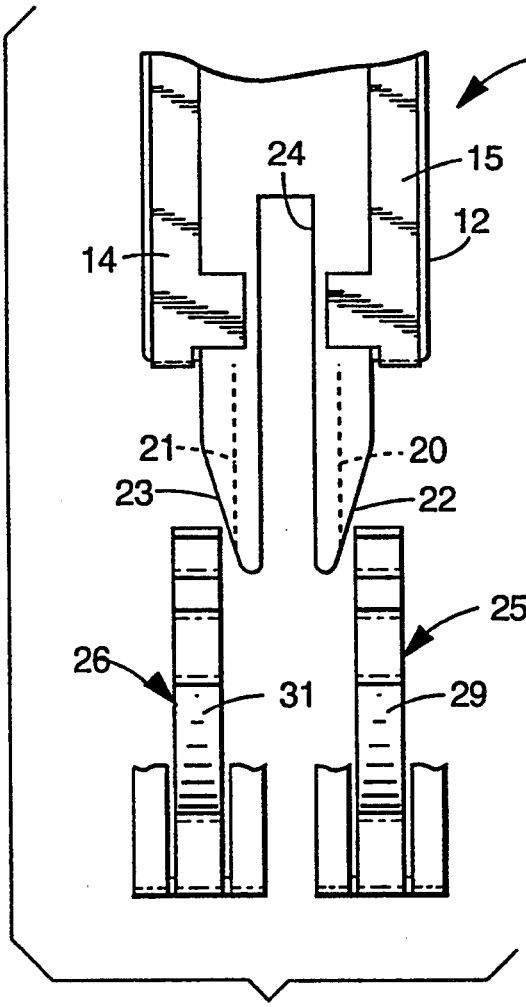
FIG. 2 is schematic transverse view of a probe being inserted between two contacts.
Figure 4:
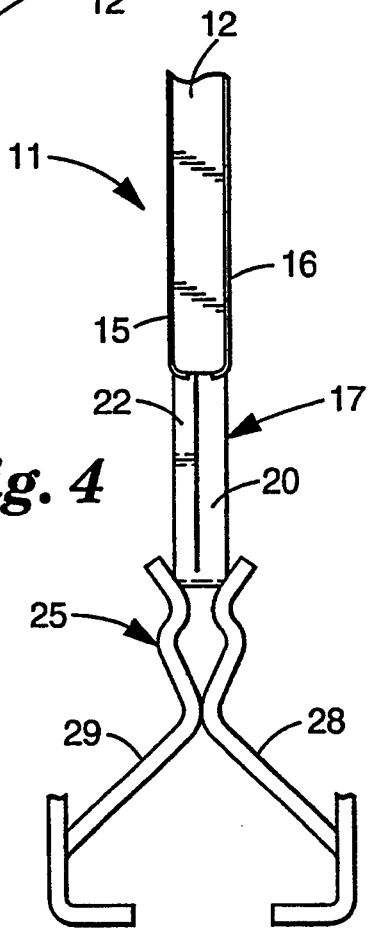
FIG. 4 is a side view of the probe being inserted between a pair of contacts.
Figure 3:
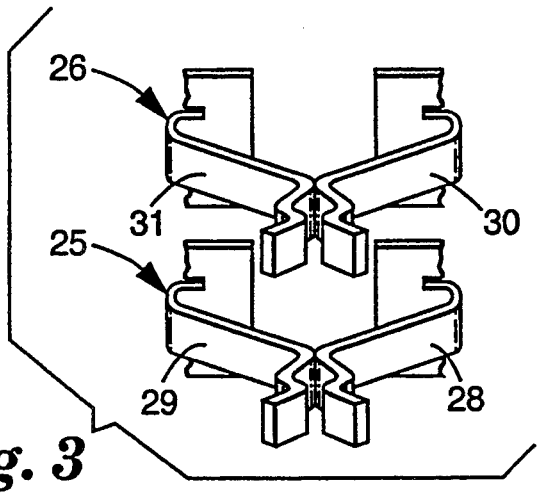
FIG. 3 is a perspective view of two contact elements of a pair of contacts illustrating only the spring contact portions thereof for purposes of illustration.

In operation, as shown in FIG. 2, the probe is inserted between the pair of contacts 25 and 26 to engage the edges of the contact elements. FIG. 3 shows the contacts in somewhat perspective form so as to show the spacing of the contacts and the connection of the contact elements. FIG. 4 illustrates the probe with relation to the upper diverging portions of the contacts.

Figure 5:
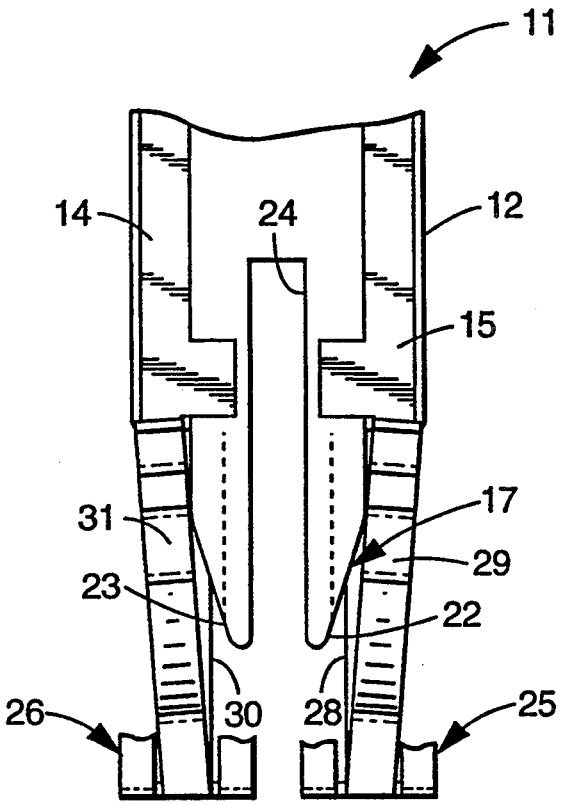
FIG. 5 is a schematic transverse view of the probe shifting two contact elements of the pair of contacts from the normal plane of contact causing a wiping between the contact faces of mating contact elements.
Figure 7:
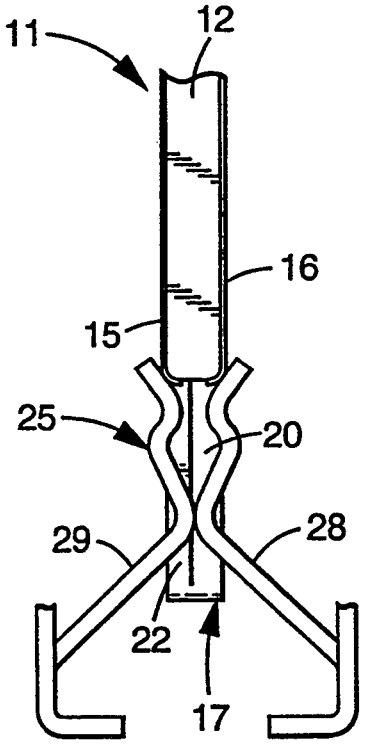
FIG. 7 is a side view of the probe and contacts.
Figure 6:
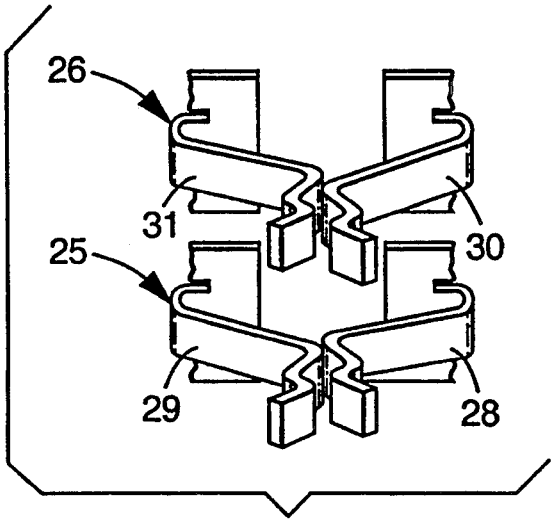
FIG. 6 is a perspective view of the two contact elements with left hand contact elements shifted in relationship to the normal plane of contact but the contacts of the pair are not electrically separated.

FIG. 5 shows the probe positioned between the pair of contacts with the diverging portions 22 and 23 of the tip forcing the spring contact elements 29 and 31 transversely of their normal electrical interconnection position. The contact elements remain in electrical connection but the bowed faces at the interface have moved transversely with respect to each other causing a wiping action at this area. As shown in FIG. 7 the end of the body 12 of the probe 11 is now entering the throat of the contact elements 28 and 29 causing the same to begin lateral separation but at the same time providing contact with the circuit traces 14, 15, and 16 as illustrated in these side views.

Figure 8:
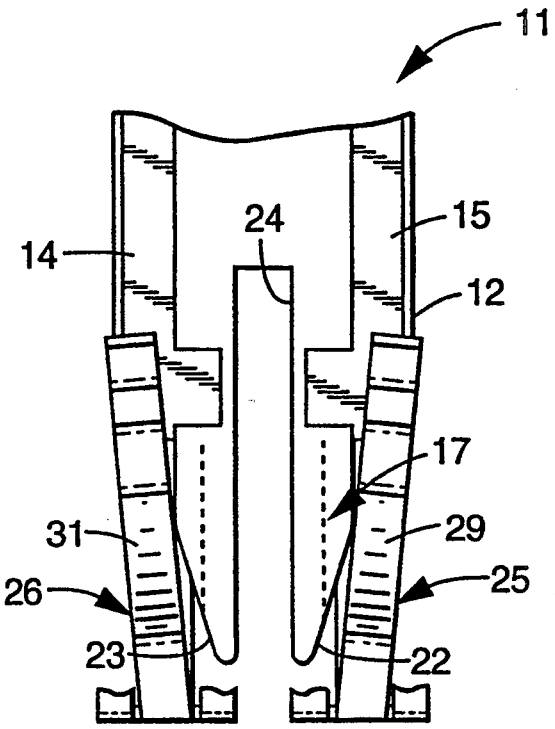
FIG. 8 is a schematic transverse view of the probe inserted between the contacts, with the contact elements of the pair of contacts electrically separated and shifted from the normal plane of contact and the ends of the spring contacts making electrical connection with the conductive paths of the probe.
Figure 10:
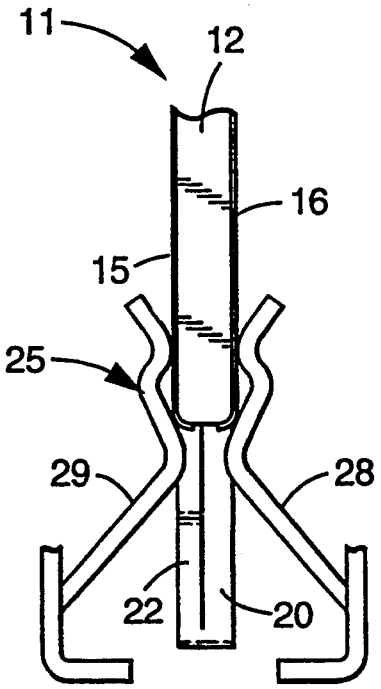
FIG. 10 is a side view of the probe and contacts, with the upper free ends of the contact elements engaging opposite sides of the probe body and the circuit paths thereon.
Figure 9:
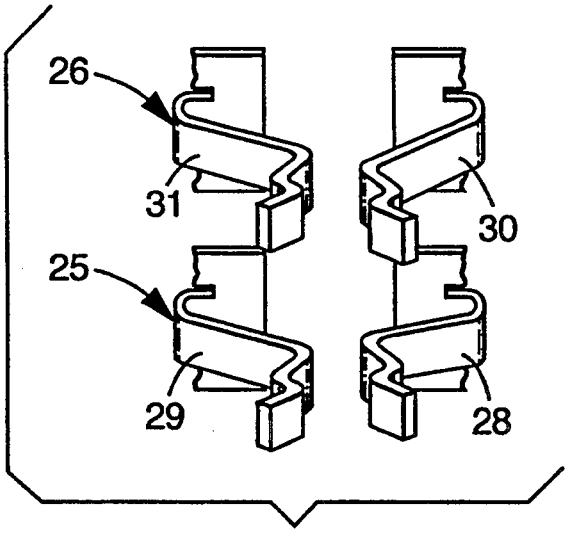
FIG. 9 is a perspective view of the pair of contacts with left hand contact elements shifted in relationship to the normal plane of contact and the contact elements of each pair electrically separated.

As illustrated in FIGS. 8, 9 and 10 the probe has now reached its position wherein the spring contact elements 29 and 31 are shifted transversely and separated from the spring contact elements 28 and 30, respectively and the second connection area of the spring contacts have made electrical connection with the circuit paths 14, 15 and 16. The contact elements in FIG. 9 are maintained in the laterally displaced relationship even with the top of the contacts engaging the circuit traces 14, 15 and 16, by the parallel edges of the terminal end joining the oblique surfaces 22 and 23 with the body 12.

Upon removal of the probe 11 the surfaces 22 and 23 will again allow the contact elements, after they have been placed in electrical contact, to wipe across the contact interface of each other such that an improved good electrical connection is made. This wiping action at the area of the interface and the separation and connection of the elements in an area different than the area where the normal electrical connection takes place, extends the life of the contact elements and improves the connection between the contact elements at the normal interface.

If the body of the probe does not have a separate circuit formed thereon and the probe is formed of insulating material, the probe can be used to break the circuit between pairs of wires, to interrupt the circuit.

Figure 11:
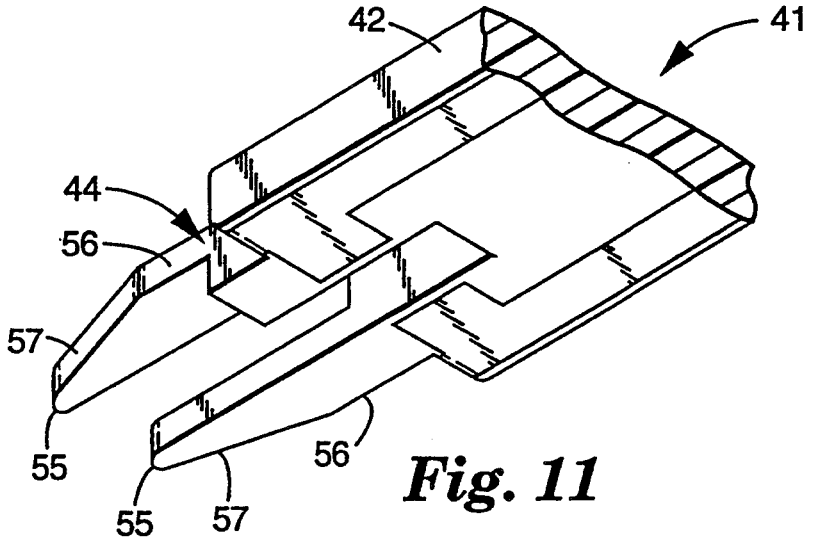
FIG. 11 is a perspective view of a second embodiment of the probe of the present invention.
Figure 12:
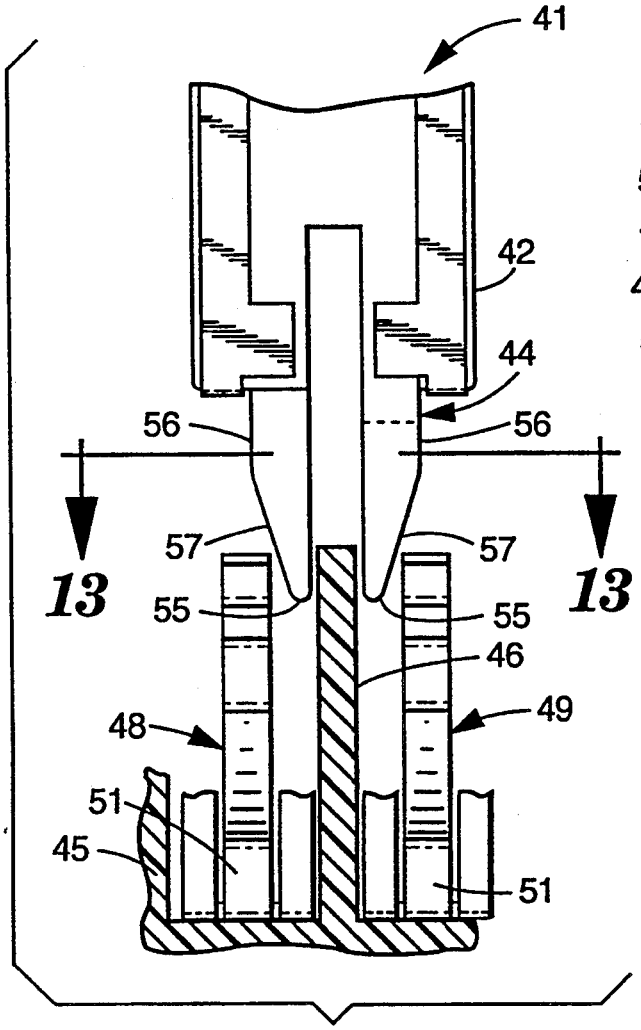
FIG. 12 is schematic transverse view of the probe according to FIG. 11 being inserted between two contacts.
Figure 13:
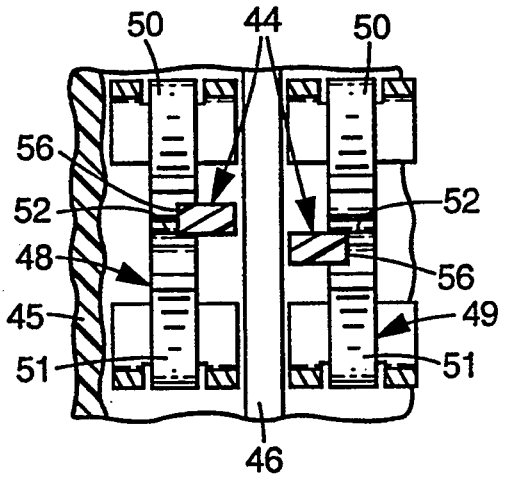
FIG. 13 is a vertical sectional schematic view of the probe of FIG. 11 being inserted between two adjacent sets of contact elements positioned on opposite sides of a contact wall.

FIG. 11 discloses another embodiment of a probe 41 for use in separating the contacts of a pair of contacts by shifting one contact laterally of the other prior to separation of the contacts at their interface. The probe 41 comprises a body 42 having a terminal end or tip 44, formed for insertion into a connector having an insulative body 45 including a wall 46, between two pairs of contacts 48, 49. Each pair of contacts comprise two contact elements 50 and 51, spring loaded into engagement at an interface generally located at 52. The probe terminal end, as illustrated, is designed to straddle the wall 46 and separate two pair of contacts 48 and 49 by a pair of tips, each having a free end 55, a first portion 56 with opposite parallel surfaces terminating at the free end 55, and a second portion having a surface 57 diverging from the free end and oblique to the parallel surfaces to engage one contact element along an edge to cause the lateral displacement of the contact element in relationship to the other contact element resulting in a wiping of the contact elements at the interface 52 between mating contact elements. As illustrated, the tips are positioned in a laterally offset relationship, or diagonally of the rectangular end of the body 42. This permits one tip to move a contact element 51 laterally of the other contact element 51, and the other tip to move a contact element 52 laterally of the other contact element 51.

The use of a terminal end having a space separating the oblique surfaces permits the probe to have a surface reacting to the biasing force on one contact. This may also be accomplished by one surface of the terminal end being in contact with the wall 46, should only one pair of contact elements need to be separated.

The portion 56 of the terminal end 44 can serve as the reaction surface, engaging the wall 46 to permit the lateral movement of one contact element and eventual separation of the contact elements of one pair of contacts at the interface.

The body 42 of the probe 41 is wider than the terminal end, and the portions 56 and 57 are positioned to engage an edge of one contact.

Having thus described the present invention with respect to a preferred embodiment will be understood that changes may be made without departing from the scope or spirit of this invention as defined in the appended claims.

We claim:

1. A probe affording the breaking and making of electrical contacts, comprising:

a body, said body having a terminal end adapted to engage two contact elements formed of electrically conductive material, which contact elements extend longitudinally from a base and have generally parallel edges and are spring loaded into electrical contact with each other along a surface between said edges, to afford sliding movement between the contact elements at their surface of contact and to afford separation of said contact elements, said terminal end being adapted to be inserted into a connector along a pair of contact elements, said terminal end having a free end and means defining an oblique surface extending along said terminal end toward said free end and adapted for engagement with one edge of one of said contact elements during insertion of a said terminal end for forcing a said contact element laterally of the other contact element.

2. A probe according to claim 1 wherein said oblique surface is disposed opposite a support surface affording a reactive support to the insertion force to shift a said contact element.

3. A probe according to claim 2 wherein said oblique surface extends to a third surface positioned between said oblique surface and said body, parallel to the direction of insertion of the probe, for maintaining a said contact element disposed at an angle to the other contact element after insertion of said probe and separation of the contact elements.

4. A probe according to claim 1 wherein said terminal end has a pair of oblique surfaces for engaging separate contact elements on two adjacent sets of electrical contact elements and said second oblique surface forms a support surface to permit separation of said contact elements of a said adjacent set of contact elements.

5. A probe according to claim 4 wherein body is generally rectangular in transverse section and said oblique surfaces are diagonally positioned with respect to said terminal end and said body whereby said oblique surfaces contact alternate contacts of said two sets of contacts.

6. A probe affording the breaking and making of electrical contact between two contact elements; said probe comprising:

a body, said body having a terminal end adapted to engage two contact elements formed of conductive material, which contact elements extend longitudinally from a base and have generally parallel edges and are spring loaded into electrical contact with each other along a bowed contact surface transverse to said edges and defined by a bend in the contact elements, which contact elements are spring loaded normally into electrical contact at the contact surfaces, said terminal end having a first portion of reduced width positioned to extend beyond said body, said portion having opposite parallel surfaces terminating at a free end and a second portion having a surface diverging from said free end and oblique to said parallel surfaces and adapted to engage an edge of a said contact element and cause the lateral displacement thereof in relationship to the other of two mating contact elements, resulting in the transverse displacement of one of the contact elements and a wiping of the contact elements at the contact surface between mating contact elements.

7. A probe according to claim 6 wherein said terminal end first portion is formed with a space separating said opposite surfaces adapted for engagement with spaced contact elements, and said second portion has a space separating two diverging surface portions adapted for engagement with the edges of separate contact elements of a pair of contacts.

8. A probe according to claim 6 wherein said body supports thin electrical circuit paths on at least one surface of said body adjacent to and transversely spaced from said terminal end for making electrical contact with said contact elements prior to the separation of said contact elements by said first and second portions of said terminal end.

9. A probe according to claim 6 wherein said terminal end is formed with a second surface which diverges from said free end, and said first and second portions are positioned in lateral spaced positions to engage the edges of two contact elements causing the transverse movement of said two contact elements of a pair of the contacts in relationship with a mating contact element affording a wiping movement of the contact elements at the electrical interface.

10. A probe according to claim 6 wherein said terminal end first portion is laterally spaced from said second portion.

11. A probe according to claim 6 wherein said terminal end first portion is laterally spaced from said second portion, said terminal end has a space dividing said terminal end to separate the transverse surfaces of said first portion and said second portion.

12. A probe according to claim 6 wherein said body and terminal end are integrally molded and said terminal end first portion is laterally spaced from said second portion, said terminal end has a space dividing said terminal end to separate the transverse surfaces of said first portion and said second portion, and the body is terminated with edges spaced transversely from said transverse surfaces of said second portion for separating the contact elements of a said pair of contacts at the interface.

* * * * *